US008235843B1

(12) United States Patent
Rice et al.

(10) Patent No.: US 8,235,843 B1
(45) **Date of Patent: *Aug. 7, 2012**

(54) GOLF CLUB HEAD WITH COMPOSITE WEIGHT PORT

(75) Inventors: Bradley C. Rice, Carlsbad, CA (US); William C. Watson, Temecula, CA (US); Patrick Dawson, San Diego, CA (US); Irina Ivanova, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/438,585

(22) Filed: Apr. 3, 2012

Related U.S. Application Data

(63) Continuation of application No. 13/363,551, filed on Feb. 1, 2012, now Pat. No. 8,197,357, and a continuation-in-part of application No. 13/248,855, filed on Sep. 29, 2011, and a continuation-in-part of application No. 12/940,371, filed on Nov. 5, 2010.

(60) Provisional application No. 61/388,124, filed on Sep. 30, 2010, provisional application No. 61/286,971, filed on Dec. 16, 2009.

(51) Int. Cl.
*A63B 53/04* (2006.01)
*A63B 53/06* (2006.01)

(52) U.S. Cl. ..... 473/334; 473/335; 473/338; 473/345; 473/349

(58) Field of Classification Search ..... 473/324–350, 473/287–292, 256
See application file for complete search history.

(56) References Cited

U.S. PATENT DOCUMENTS

| | | | | | |
|---|---|---|---|---|---|
| 2,056,335 | A * | 10/1936 | Wettlaufer | 473/245 |
| 3,556,533 | A * | 1/1971 | Hollis | 473/338 |
| 3,582,081 | A * | 6/1971 | Caplan | 473/338 |
| 3,692,306 | A * | 9/1972 | Glover | 473/306 |
| 4,085,934 | A * | 4/1978 | Churchward | 473/338 |
| 4,650,626 | A * | 3/1987 | Kurokawa | 264/278 |
| 4,795,159 | A * | 1/1989 | Nagamoto | 473/338 |
| 4,869,507 | A * | 9/1989 | Sahm | 473/337 |
| 5,050,879 | A * | 9/1991 | Sun et al. | 473/338 |
| 5,447,309 | A * | 9/1995 | Vincent | 473/345 |
| 5,871,407 | A * | 2/1999 | Tseng | 473/328 |
| 5,947,840 | A * | 9/1999 | Ryan | 473/335 |
| 6,089,994 | A * | 7/2000 | Sun | 473/338 |
| 6,409,612 | B1 * | 6/2002 | Evans et al. | 473/324 |
| 6,773,360 | B2 * | 8/2004 | Willett et al. | 473/334 |
| 6,974,393 | B2 * | 12/2005 | Caldwell et al. | 473/324 |
| 7,108,609 | B2 * | 9/2006 | Stites et al. | 473/256 |
| 7,147,576 | B2 | 12/2006 | Imamoto et al. | |
| 7,189,169 | B2 * | 3/2007 | Billings | 473/332 |
| 7,198,575 | B2 * | 4/2007 | Beach et al. | 473/324 |
| 7,258,624 | B2 | 8/2007 | Kobayashi | |
| 7,318,782 | B2 | 1/2008 | Imamoto et al. | |
| 7,344,452 | B2 | 3/2008 | Imamoto et al. | |

(Continued)

*Primary Examiner* — Sebastiano Passaniti
(74) *Attorney, Agent, or Firm* — Rebecca Hanovice; Michael A. Catania; Sonia Lari

(57) ABSTRACT

A golf club head having a face component, a crown, and a composite sole or a composite body patch with one or more weight ports for receiving one or more weight inserts is disclosed herein. At least part of each of the weight ports is integrally formed in the composite sole or composite body patch, and each of the weight ports include a weight receiving region for receiving a weight and a screw receiving region for receiving a screw that secures the weight in the weight port.

17 Claims, 10 Drawing Sheets

U.S. PATENT DOCUMENTS

| | | | | |
|---|---|---|---|---|
| 7,377,860 | B2 * | 5/2008 | Breier et al. | 473/334 |
| 7,407,447 | B2 * | 8/2008 | Beach et al. | 473/324 |
| 7,445,564 | B2 | 11/2008 | Kusumoto | |
| 7,455,600 | B2 | 11/2008 | Imamoto et al. | |
| 7,462,110 | B2 * | 12/2008 | Yamamoto | 473/334 |
| 7,497,788 | B2 | 3/2009 | Imamoto et al. | |
| 7,503,853 | B2 | 3/2009 | Matsunaga | |
| 7,520,822 | B2 | 4/2009 | Yamagishi et al. | |
| 7,524,249 | B2 | 4/2009 | Breier et al. | |
| 7,530,901 | B2 | 5/2009 | Imamoto et al. | |
| 7,530,903 | B2 | 5/2009 | Imamoto et al. | |
| 7,540,812 | B2 | 6/2009 | Imamoto et al. | |
| 7,628,711 | B2 * | 12/2009 | Akinori et al. | 473/335 |
| 7,632,194 | B2 * | 12/2009 | Beach et al. | 473/334 |
| 7,658,686 | B2 | 2/2010 | Soracco | |
| 7,803,065 | B2 | 9/2010 | Breier et al. | |
| 7,871,339 | B2 * | 1/2011 | Sanchez et al. | 473/335 |
| 7,938,740 | B2 | 5/2011 | Breier et al. | |
| 8,007,371 | B2 | 8/2011 | Breier et al. | |
| 8,020,606 | B2 * | 9/2011 | Chao et al. | 164/516 |
| 8,033,930 | B2 * | 10/2011 | Tavares et al. | 473/339 |
| 8,062,151 | B2 * | 11/2011 | Boyd et al. | 473/334 |
| 8,092,316 | B2 * | 1/2012 | Breier et al. | 473/244 |
| 2005/0043115 | A1 * | 2/2005 | Lin | 473/345 |
| 2006/0058112 | A1 * | 3/2006 | Haralason et al. | 473/334 |
| 2006/0105856 | A1 * | 5/2006 | Lo | 473/334 |
| 2006/0217216 | A1 * | 9/2006 | Iizuka | 473/349 |
| 2007/0054751 | A1 | 3/2007 | Breier et al. | |
| 2008/0039228 | A1 * | 2/2008 | Breier et al. | 473/334 |
| 2010/0311520 | A1 * | 12/2010 | Bezilla et al. | 473/335 |

* cited by examiner

GOLF CLUB HEAD WITH COMPOSITE WEIGHT PORT

CROSS REFERENCES TO RELATED APPLICATIONS

The present application is a continuation of U.S. patent application Ser. No. 13/363,551, filed on Feb. 1, 2012, which is a continuation-in-part of U.S. patent application Ser. No. 13/248,855, filed on Sep. 29, 2011, which claims priority to U.S. Provisional Application No. 61/388,124, filed on Sep. 30, 2010, and is a continuation-in-part of U.S. patent application Ser. No. 12/940,371, filed on Nov. 5, 2010, which claims priority to U.S. Provisional Application No. 61/286,971, filed on Dec. 16, 2009, each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a composite sole or composite body patch with one or more weight ports to house one or more removable weights. More specifically, the present invention relates to a golf club head having a composite sole or composite body patch with integrally formed weight ports and a removable, metal weight insert.

2. Description of the Related Art

As driver golf club heads have increased in volume to greater than 300 cubic centimeters, their moments of inertia have also increased, providing greater forgiveness for off-center hits. The conventional method for enlargement of golf club heads was to maximize the spatial distribution of mass in all three orthogonal orientations. Although this approach was effective in increasing the moments of inertia of the golf club heads, it also resulted in the center of gravity of the golf club head being positioned substantially rearward from the front face of the golf club head.

As the center of gravity is positioned further rearward from the front face, deleterious effects result for shots struck off-center from the sweet spot of the golf club head. Increased gear effect is the main cause of the deleterious effects. For heel-ward or toe-ward off-center hits, the increased gear effect can cause increased side-spin, which increases dispersion, reduces distance and reduces robustness of ball flight. For off-center hits above the sweet spot, the increased gear effect causes reduced backspin, which can cause an undesirable trajectory having insufficient carry length or time of flight, which in turn can result in reduced distance and reduced robustness.

In addition, the same conventional golf club head designs are limited with regard to the maximum face area, both physical and practical limitations. The physical limitation is due to the golf club head having insufficient mass to both increase the length and width of the golf club head and also to increase the face size without exceeding the upper range of the preferred total golf club head mass. Such mass distributions are dependent on minimum wall thickness values required to achieve acceptable in-service durability.

The practical limitation is that as the face size is increased, hit locations in certain regions around the face perimeter will yield an unsatisfactory ball flight due to the above-mentioned deleterious effects, which are accentuated for larger faces. The deleterious effects increase in a non-linear manner as the distance from the face center increases. Thus the incremental face area gained by increasing face size will be subject to more extreme deleterious effects. This limits the practical length of the club, because probable hit distribution across the surface of the face broadens as the club length increases. As a result, a longer club will yield a larger percentage of hits in the perimeter regions of the face where the deleterious effects occur. This offsets the otherwise beneficial effect of increased head speed. As club length increases, head speed increases up to a length of approximately 52 inches, at which point aerodynamic and biomechanical effects offset the length effect.

Further, conventional head designs having a center of gravity positioned substantially rearward from the face are subject to significant dynamic loft effects, which can be undesirable. Dynamic loft increases with head speed, so that golfers with higher head speeds experience more dynamic loft than those with slower swing speeds. This is opposite of what is desired as higher head speeds generally require less loft, otherwise excess backspin will be generated, which negatively affects trajectory and performance.

Currently, golf club heads made of metal, composite, or other material are produced with a specific weight which is fixed once the golf club head is finished. The fixed weight of the golf club head determines the center of gravity and moment of inertia. After the golf club head is finished, there exists a small amount of weight which needs to be adjusted. This small amount of weight is called the swing weight. Presently, if the swing weight needs to be adjusted, to alter the center of gravity and/or moment of inertia, the fixed weight must be changed, which requires the manufacture of a new golf club head.

One invention that addresses a golf club head with an improved moment of inertia and center of gravity is U.S. Pat. No. 7,559,851 issued to Cackett et al. for Golf Club Head with High Moment of Inertia. This patent discloses a golf club head with a moment of inertia, Izz, about the center of gravity of the golf club head that exceeds 5000 grams-centimeters squared.

Another example is U.S. Pat. No. 3,897,066 to Belmont which discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate.

The capsules have openings on a rear surface of the club head with covers to provide access to adjust the weight means.

Yet another example is U.S. Pat. No. 2,750,194 to Clark which discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

Although the prior art has disclosed many variations of golf club heads with weight adjustment means, the prior art has failed to provide a club head with both a superior material construction and a high-performance weighting configuration.

BRIEF SUMMARY OF THE INVENTION

It is the object of this invention to adjust the swing weight of the golf club head externally, without having to manufacture or purchase a new golf club head. A golfer using the present invention will be able to adjust the center of gravity and moment of inertia to best suit his or her playing needs. The golf club head has external weights positioned at specific locations on the golf club head body to improve the center of gravity and moment of inertia characteristics. The weights to be inserted into the cavities of the golf club head all may be of the same size and shape, however will vary in density. This allows for the weights to be interchangeable depending on the golfer's individual needs. The aft-body of the golf club head is preferably composed of a composite material with recessed cavities to engage the weights. Alternatively, the aft-body comprises a cutout covered by a body patch composed of composite material having one or more recessed cavities to engage the weights.

One aspect of the invention is a golf club head comprising a face component, a crown, and a composite sole having exterior and interior surfaces, wherein the composite sole includes at least one weight port. In another embodiment of the invention, the weight port comprises a composite component and a metal component. In yet a further embodiment of the invention, the metal component is affixed to the interior surface of the composite sole. In a further embodiment of the invention, the golf club head comprises a weight insert, wherein the weight insert is affixed to the weight port with a screw. In yet another embodiment of the invention, the weight insert is composed of a metal material. In an alternative embodiment of the invention, the screw is composed of a metal material. In a further embodiment of the present invention, the weight port has a conical shape and the weight insert has a shape that fits within the weight port. In a further embodiment of the present invention, the weight insert has a conical shape.

Another aspect of the present invention is a golf club head comprising a metal face component, a crown, a composite sole, and a metal weight insert having a conical shape, wherein the composite sole has at least one, integrally formed weight port, wherein the weight port is conical in shape, wherein the weight port has a metal screw receiving component, and wherein the weight insert is affixed to the weight port with a metal screw. In another embodiment, the metal screw receiving component is threaded. In yet another embodiment, the metal screw attaches to the metal screw receiving component and thereby secures the weight insert in the weight port. In a further embodiment, the face component is composed of titanium. In another embodiment, the crown is composed of titanium. In yet another embodiment, the crown is composed of composite material. In another embodiment, the sole has at least three integrally formed weight ports and at least three metal weight inserts. In another embodiment, the golf club is a driver. In yet another embodiment, the golf club is a fairway wood.

Another aspect of the present invention is a wood-type golf club head comprising a metal face component comprising a striking surface and a face extension, an aft body comprising a crown, a sole, an interior surface, an exterior surface, and a cutout portion, and a composite body patch comprising an interior surface, an exterior surface, and at least one, integrally formed weight port, wherein the weight port comprises a composite component and a metal boss, and wherein the composite body patch is affixed to the aft body and covers the cutout portion. In some embodiments, the metal boss may be affixed to the interior surface of the composite body patch. In other embodiments, the metal boss may be affixed to the exterior surface of the composite body patch. In another embodiment, the aft body may further comprise a ledge surrounding the cutout portion, and a portion of the interior surface of the composite body patch may be affixed to the exterior surface of the ledge with an adhesive. In some embodiments, the composite body patch may further comprise a ledge, and the exterior surface of the ledge may be affixed to the interior surface of the aft body with an adhesive. This embodiment may further comprise a weight insert affixed to the weight port with a screw. The weight port may have a conical shape and the weight insert may have a shape that fits within the weight port. In an alternative embodiment, the present invention may further comprise a weight screw comprising a head portion and a screw portion, which may have a weight of at least 1 gram and no more than 20 grams. This embodiment may be a driver having a volume of 400 to 500 cubic centimeters.

Another aspect of the present invention is a golf club head comprising a metal face component, an aft body comprising a crown, a sole, and a cutout portion, a composite body patch, a threaded boss composed of a metal material, and a weight screw, wherein the composite body patch comprises an exterior surface, an interior surface, and at least one, integrally formed weight port, wherein the threaded boss is affixed to the at least one weight port with an adhesive, wherein the composite body patch is affixed to the aft body with an adhesive and covers the cutout portion, and wherein the golf club head has a volume of 400 to 500 cubic centimeters. The cutout portion may be located on a toe section of the aft body. In some embodiments, the face component and the aft body may be composed of a titanium alloy. In other embodiments, the crown may be composed of a composite material, the sole may be composed of a metal alloy, and the cutout may be located on the sole. The aft body may in some embodiments comprise at least one integrally formed weight port. In other embodiments, the composite body patch may have an asymmetrical shape. In yet another embodiment, the aft body may further comprise a ledge surrounding the cutout portion, and the interior surface of the composite body patch may be affixed to the exterior surface of the ledge. In an alternative embodiment, the composite body patch may comprise a ledge, and the external surface of the ledge may be affixed to the interior surface of the aft body.

Another aspect of the present invention is a driver-type golf club head comprising a face component comprising a striking surface and a return portion, the face component composed of a titanium alloy, an aft body comprising a toe side, a heel side, a crown, a sole, and a cutout portion, the aft body composed of a titanium alloy, a composite body patch comprising an exterior surface, an interior surface, a ledge, and at least one, integrally formed weight port, a threaded boss composed of a metal material, and a weight screw comprising threads sized to fit within the threaded boss, wherein the threaded boss is affixed to the weight port, wherein an exterior surface of the ledge is affixed to the interior surface of the aft body with an adhesive material such that the composite patch fully covers the cutout portion, and wherein the golf club head has a mass of 180 grams to 215 grams. In some embodiments, the cutout portion may be located in the sole proximate a toe side of the golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
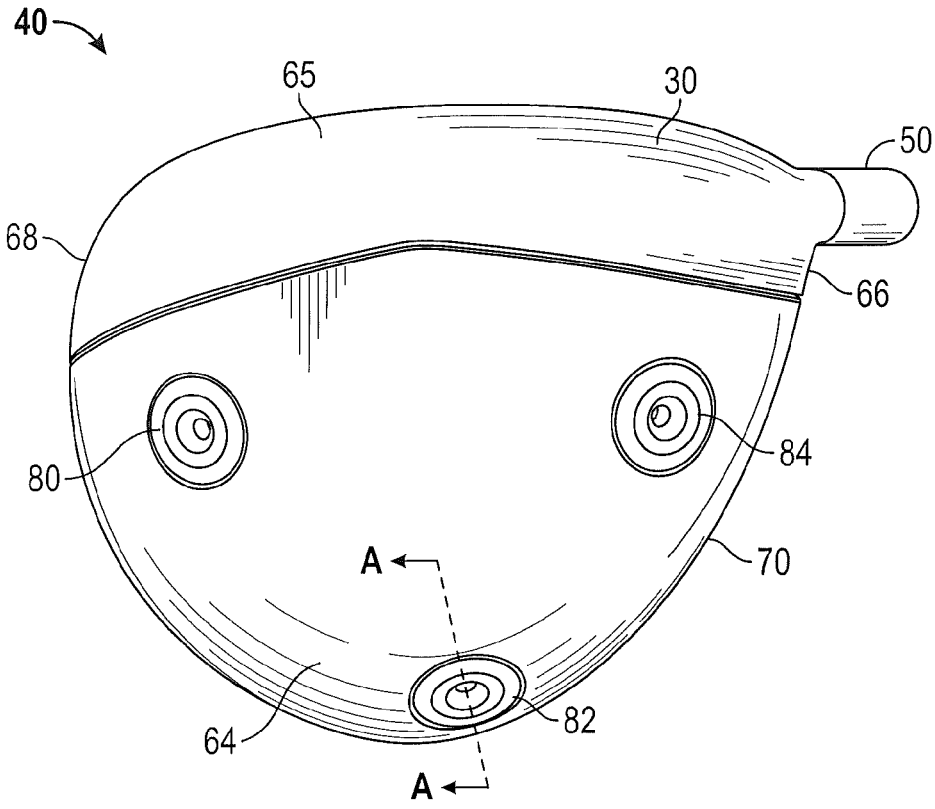
FIG. 1 is sole-side view of a golf club head according to an embodiment of the present invention.
Figure 2:
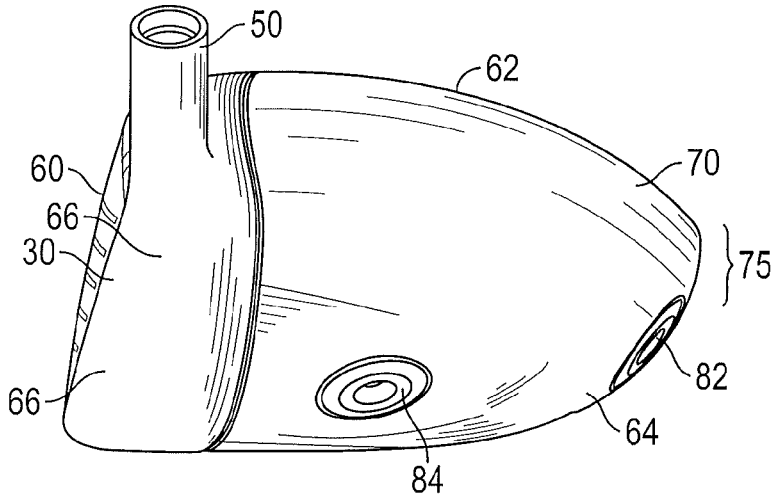
FIG. 2 is a heel-side view of the golf club head shown in FIG. 1.
Figure 3:
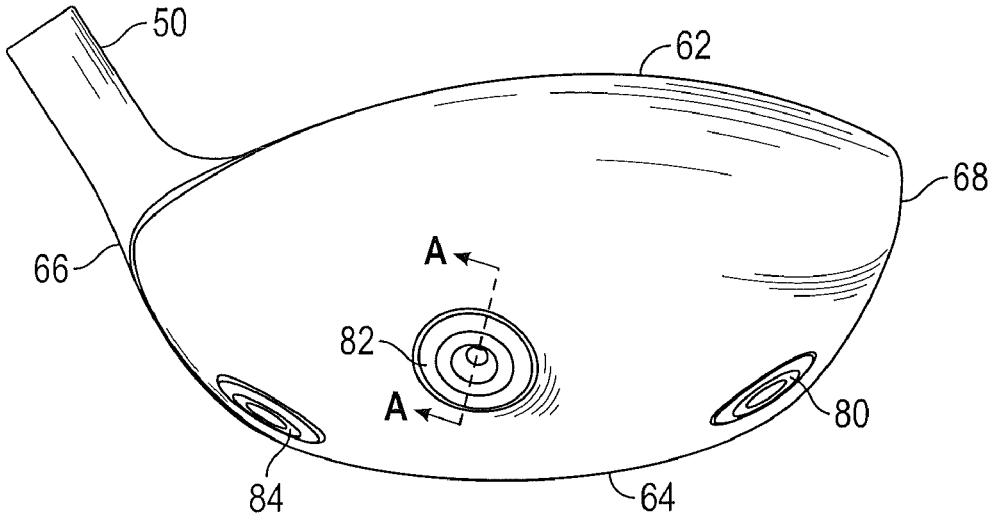
FIG. 3 is a rear view of the golf club head shown in FIG. 1.

The present invention is generally directed to a golf club head with one or more weight ports that are formed in a composite sole or a composite sole patch and house removable weight inserts. In the preferred embodiments, the one or more weight ports are integrally formed in the sole or body patch.

Views of the preferred embodiment of the present invention are shown in FIGS. 1-5. The golf club head 40 shown in FIGS. 1-3 has a hollow interior 90, shown in FIG. 5, and is generally composed of a face component 30 comprising a face 60, a face extension 65, and a hosel 50, and an aft body 70 comprising a crown 62 and a sole 64 having three weight ports 80, 82, 84. In alternative embodiments, the golf club head 40 may have one, two, or more than three weight ports. The club head 40 also may optionally have a ribbon, skirt, or side portion (not shown) disposed between the crown 62 and sole 64 portions. The golf club head 40 is preferably partitioned into a heel section 66 nearest the hosel 50, a toe section 68 opposite the heel section 66, and a rear section 75 opposite the face component 60. The preferred embodiment of the golf club head 40 shown in FIGS. 1-5 has a volume of approximately 460 cubic centimeters and a face 60 with a characteristic time that is close to, but does not exceed, 257 μs.

In the preferred embodiment shown in FIGS. 1-5, the face component 30 is made of titanium and the aft body 70 (including the crown 62 and sole 64) is made of a composite material. The composite crown 62 and sole 64 may be formed using one or more of the techniques described in U.S. Patent Publication Nos. 20100139079 and 20110065528, and U.S. patent application Ser. No. 12/886,773, the disclosures of which are hereby incorporated by reference in their entireties herein.

Figure 4:
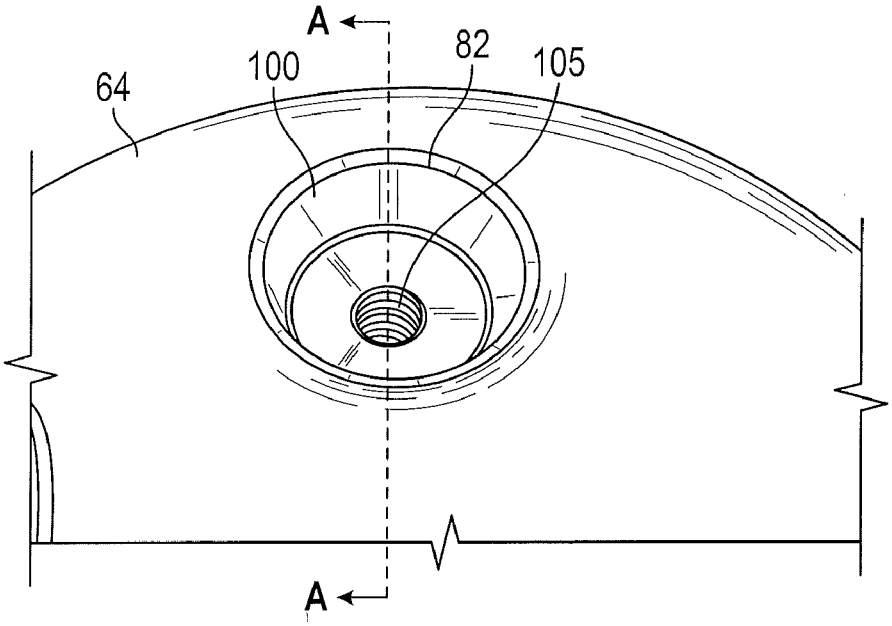
FIG. 4 is a top view of a weight port shown in FIG. 1.
Figure 5:
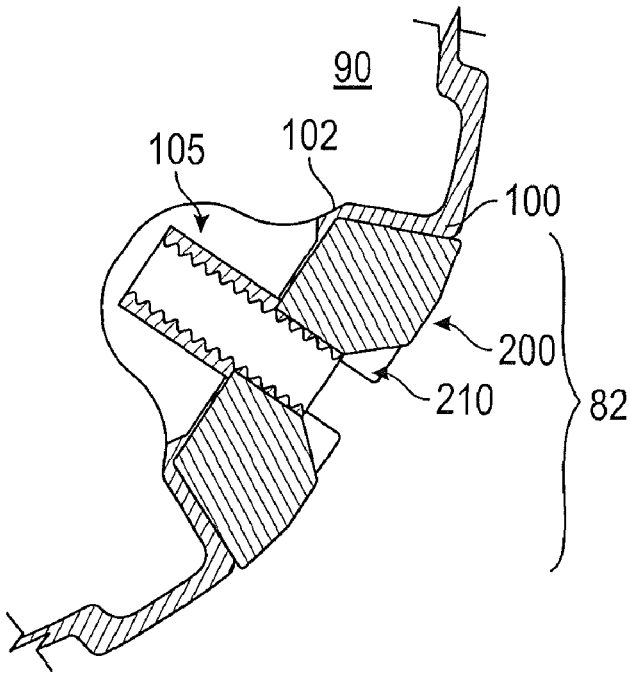
FIG. 5 is a cross-sectional view of the weight port and golf club head shown in FIG. 4 along line A-A.

At least part of each weight port 80, 82, 84 is integrally formed in the composite sole 64. As shown in FIGS. 4 and 5, the weight port 82 comprises a weight receiving region 100 and a screw-receiving region 105. In the preferred embodiment, the weight receiving region 100 is the portion of the weight port 82 that is integrally formed in the composite and the screw-receiving region 105 is a separate metal piece, e.g., a screw-receiving boss with internal threads, which is affixed to the interior surface 102 of the composite weight receiving region 100. The screw-receiving region 105 preferably is affixed to the interior surface 102 of the composite weight receiving region 100 with an adhesive or another means.

Figure 7:
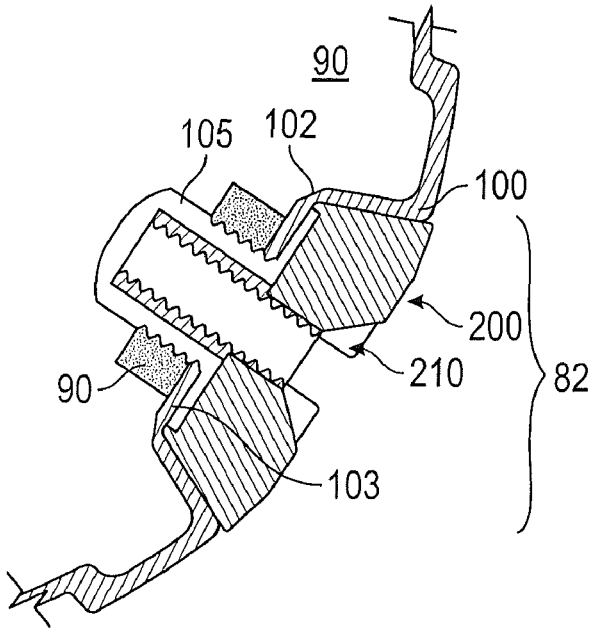
FIG. 7 is a cross-sectional view of an alternative configuration of the weight port and golf club head shown in FIG. 4 along line A-A.

The screw-receiving region 105 may also, in an embodiment shown in FIG. 7, be affixed to the exterior surface 103 of the composite weight receiving region 100 with an adhesive or with a mechanical fastener such as a nut 90, which is affixed to a lower portion of the screw-receiving region 105 to effectively sandwich the weight-receiving region 100 between the screw-receiving region 105 and the nut 90. In this embodiment, the screw-receiving region 105 rests against the exterior surface 103 of the weight receiving region 100 and extends into the golf club head. If the screw-receiving region 105 is mechanically affixed to the weight receiving region 100 in this manner, it is preferable for an exterior surface of the screw-receiving region 105 to have threads so that the nut 90 can securely engage with the screw-receiving region 105. Other techniques of affixing the screw-receiving region 105 to the composite weight receiving region 100 may be utilized. In alternative embodiments, the screw-receiving region 105 may be composed of a material other than metal, such as composite or plastic.

As shown in FIG. 5, a weight 200 is placed into the weight port 82 and received by the composite weight receiving region 100. The weight 200 is secured within the weight port 82 with a screw 210. The weight 200 may be removed from the weight port 82 by unscrewing the screw 210 and removing both the screw 210 and the weight 200 from the weight port 82.

Figure 6:
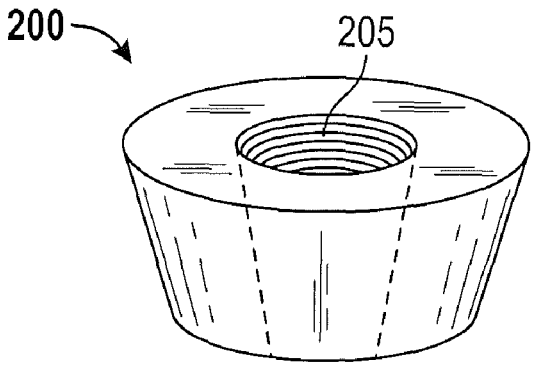
FIG. 6 is a side perspective view of a weight insert that can be used with the golf club head shown in FIG. 1.
Figure 8:
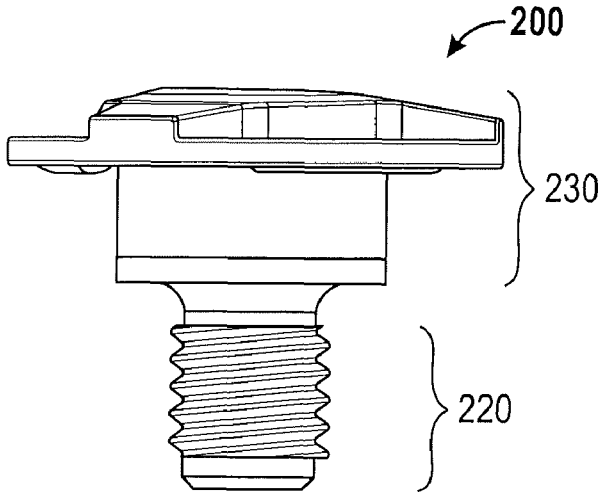
FIG. 8 is a side plan view of an alternative weight that can be used with the golf club head of the present invention.

In the preferred embodiment, the weight ports 80, 82, 84 are shaped to receive a conical weight. Also in the preferred embodiment, the weight 200 is conical in shape with a central aperture 205 for receiving a screw 210, as shown in FIG. 6, and both the weight 200 and the screw 210 are composed of a metal material. The weight 200 and screw 210 may, in alternative embodiments, be composed of other materials, such as composite or plastic. In some embodiments, the weight 200 and/or screw 210 may be made of stainless steel, titanium, tungsten, or other metal materials. In an alternative embodiment, the weight 200 may be a different shape, such as asymmetric or cylindrical instead of conical, and may comprise an integrally formed screw portion 220 as shown in FIG. 8, which makes a separate screw 210 unnecessary. In the embodiment shown in FIG. 8, the weight 200 is a weight screw having an integrally formed screw portion 220 and a cylindrical head portion 230.

The weight 200 preferably ranges in mass between 1 grams and 40 grams, more preferably between 10 grams and 30 grams, and most preferably 15 grams to 25 grams. More specifically, if the weight 200 is chosen for insertion in the toe-section 68 weight port 80, the weight 200 preferably ranges in mass between 5 grams and 25 grams, more preferably between 6 grams and 20 grams, and most preferably 6 grams to 16 grams. More specifically, if the weight 200 is chosen for insertion in the heel section 66 weight port 84, the weight 200 preferably ranges in mass between 10 grams and 40 grams, more preferably between 10 grams and 30 grams, and most preferably 12 grams to 29 grams. More specifically, if the weight 200 is chosen for insertion in the rear section 75 weight port 82, the weight 200 preferably ranges in mass between 10 grams and 40 grams, more preferably between 15 grams and 30 grams, and most preferably 23 grams.

Other embodiments of the present invention are shown in FIGS. 9-12. In these embodiments, only a portion of the aft body 70, specifically a body patch 300, is formed of a composite material. The remainder of the aft body 70, which includes a cutout portion 77 in the sole 64 near the toe section 68 of the club head 40, can be composed of any material, but is most preferably composed of a metal alloy, and most preferably a titanium alloy such as 6-4 titanium. The aft body 70 includes a ledge 72 against which the composite body patch 300 rests and to which the composite body patch 300 is bonded. In alternative embodiments, discussed in greater detail herein, the composite body patch 300 may comprise a ledge 305 instead of or in addition to the aft body 70 ledge 72. In alternative embodiments, the cutout portion 77 may be located in an area of the aft body 70 other than the toe section 68. The composite body patch 300 may be formed using one or more of the techniques described in U.S. Patent Publication Nos. 20100139079 and 20110065528, and U.S. patent application Ser. No. 12/886,773, and includes an integrally formed weight port 350 similar or identical to the one described with reference to the embodiments shown in FIGS. 1-5.

Figure 9:
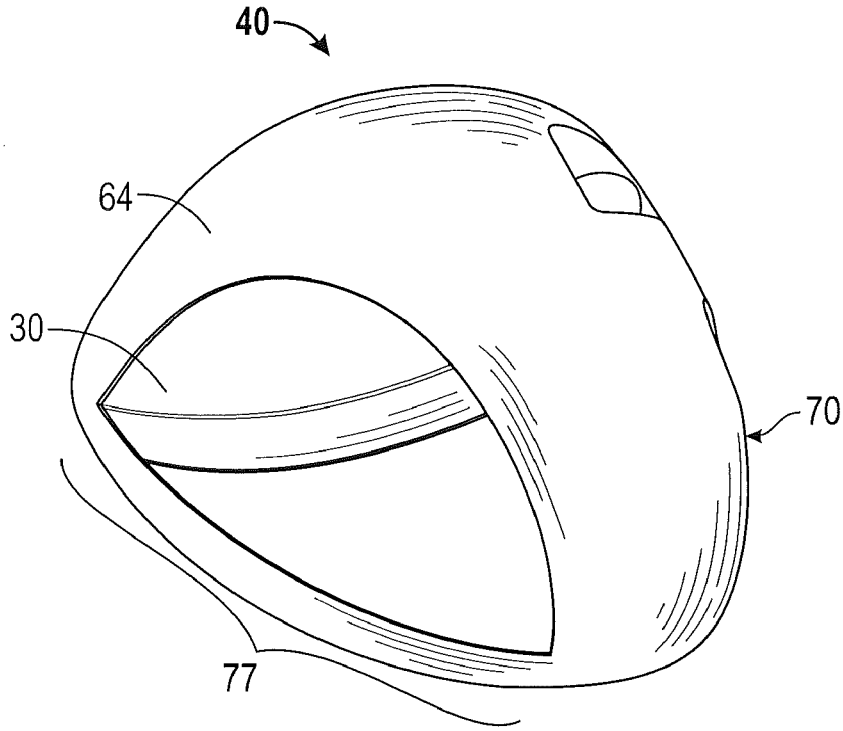
FIG. 9 is a bottom, rear perspective view of a second embodiment of the present invention with an exposed cutout portion.
Figure 10:
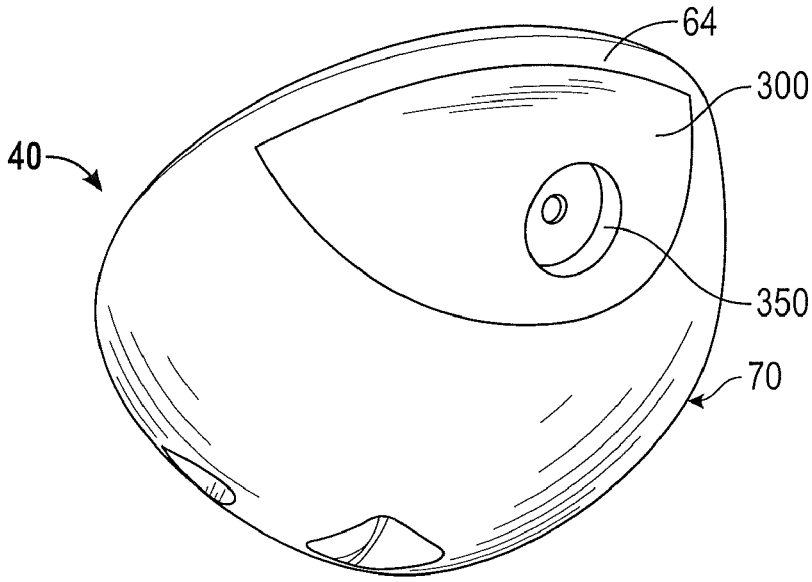
FIG. 10 is a bottom, toe-side perspective view of the embodiment shown in FIG. 9 with the cutout portion covered by a composite body patch.
Figure 11:
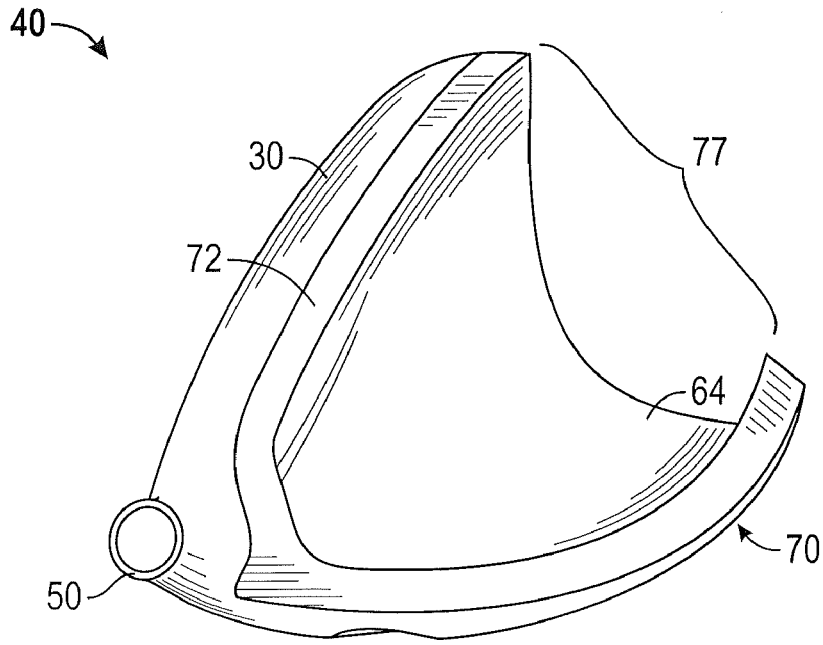
FIG. 11 is top perspective view of a third embodiment of the present invention with an exposed cutout portion.
Figure 12:
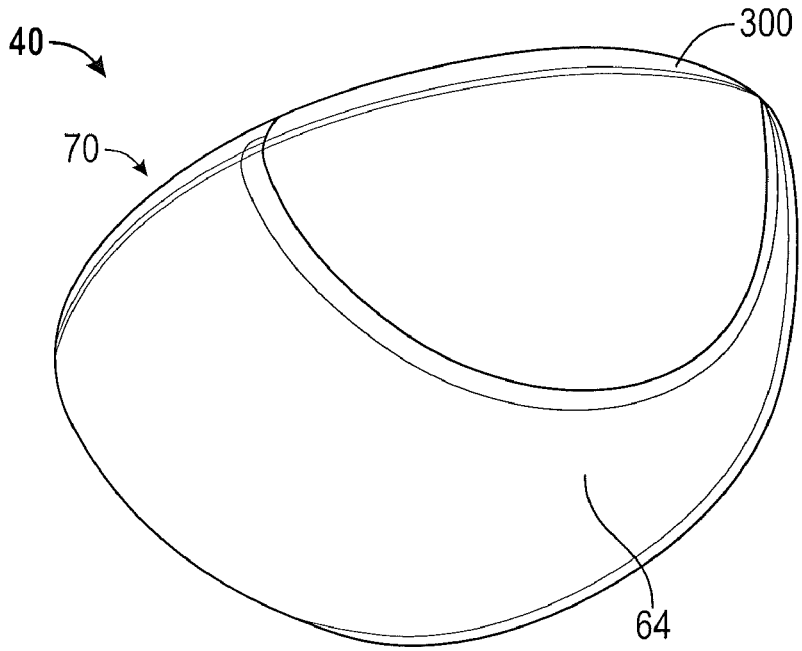
FIG. 12 is a bottom, toe-side perspective view of the embodiment shown in FIG. 11 with the cutout portion covered by a composite body patch.
Figure 13:
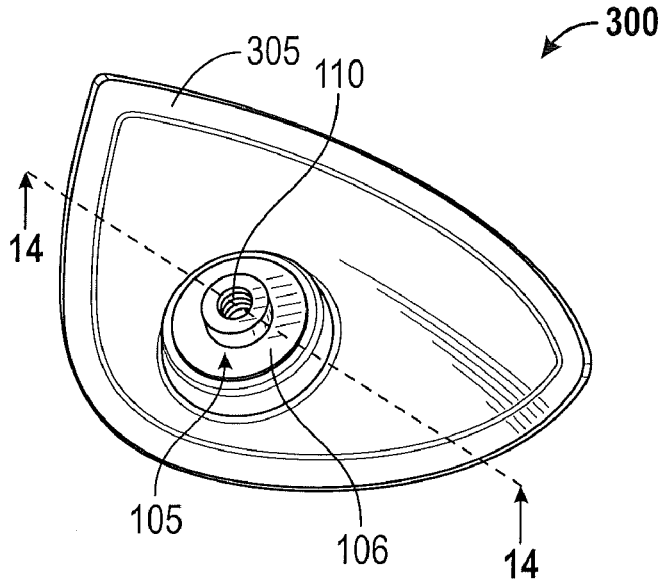
FIG. 13 is a rear perspective view of an embodiment of a composite body patch of the present invention.

As shown in FIGS. 9-12, the composite body patch 300, which preferably has an asymmetric, teardrop shape (but can be manufactured to have any desired shape), is sized to completely cover the cutout portion 77 of the aft body 70, thus preventing dirt and debris from entering the golf club head 40. The composite body patch 300 preferably is permanently affixed to the aft body 70 with an adhesive material. The cutout portion 77 preferably is circumscribed entirely by the material of the sole 64, as shown in FIGS. 9 and 10, but in an alternative embodiment it may be enclosed by the sole 64 on only one or two sides, as shown in FIGS. 11 and 12. In both of these structures, the crown (not shown) may be integrally cast with the rest of the club head, or it may be affixed to the club head 40 after the composite body patch 300 has been bonded to the sole 64. The crown used with this embodiment is preferably composed of a metal alloy material, but it may instead be a composite material formed using one or more of the techniques referenced above.

The composite body patch 300 shown in FIGS. 9-12 may be formed to have a consistent shape and size, such that it can be mass-produced for use in many different club heads. The composite body patch 300 is preferably formed with a ledge 305 to assist in alignment with the aft body 70 of the golf club head 40. The weight port 350 of the composite body patch 300 may have different features, as shown in FIGS. 13-20. In particular, the metal screw-receiving boss 105 may have different configurations and can be affixed to the weight receiving region 100 of the weight port 350 in different ways. The manner in which the metal screw-receiving boss 105 is affixed to the weight port 350 can affect both the durability of the weight port 350 and the retention of the weight 200 within the weight port 350. The features shown in FIGS. 13-20 may be applied to the weight ports 80, 82, 84 disclosed in connection with the preferred embodiment shown in FIGS. 1-5 in addition to the weight port 350 disclosed in connection with the composite body patch 300.

Figure 14:
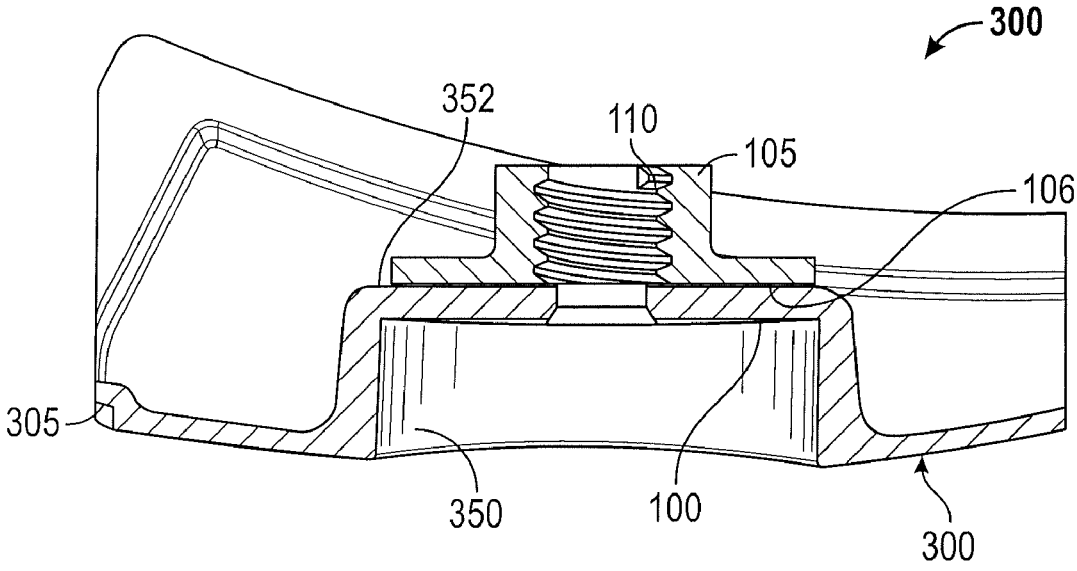
FIG. 14 is a cross-sectional view of the composite body patch shown in FIG. 13 along lines 14-14.
Figure 16:
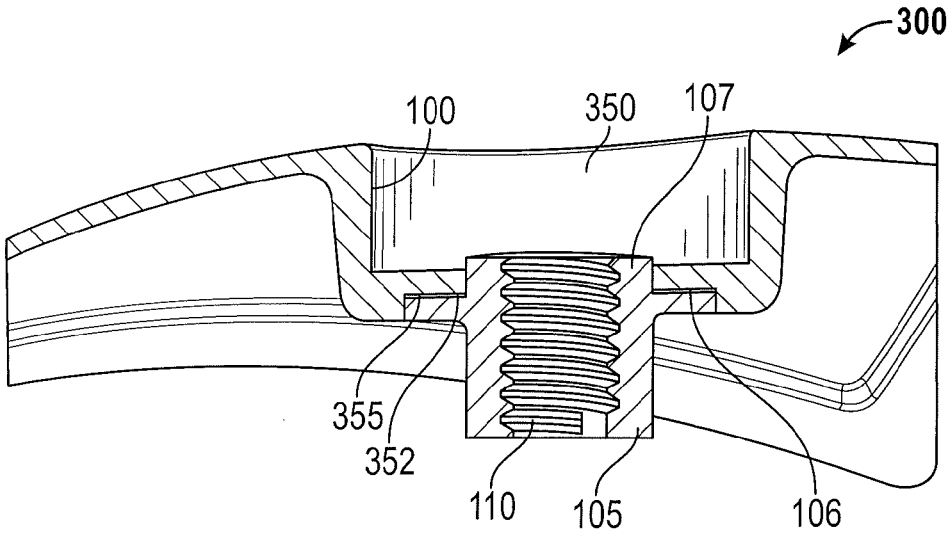
FIG. 16 is a cross-sectional view of the composite body patch shown in FIG. 15 along lines 16-16.
Figure 18:
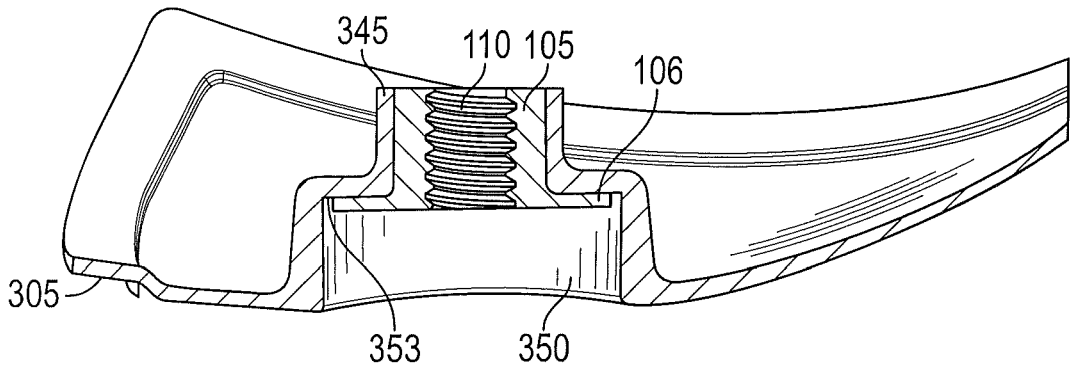
FIG. 18 is a cross-sectional view of the composite body patch shown in FIG. 17 along lines 18-18.

As shown in FIGS. 14, 16, and 18, the metal screw-receiving boss 105 preferably has an upper flange 106 and an internal bore 110 with threads sized to receive either a screw 210 or the integrally formed screw portion 220 of a weight screw. The metal screw-receiving boss 105 preferably is a single piece of metal that is either cast, forged, or machined to have the features described herein. In the embodiment shown in FIGS. 13 and 14, the upper flange 106 of the metal screw-receiving boss 105 is affixed to an interior surface 352 of the weight receiving region 100 of the integrally formed weight port 350. The flange 106 preferably rests against and is bonded to the interior surface 352 with a strong adhesive material. In this configuration, the weight 200, or the cylindrical head portion 230 of a weight screw, never directly touches the metal screw-receiving boss 105, as it is separated from the boss 105 by the composite material of the weight receiving region 100.

Figure 15:
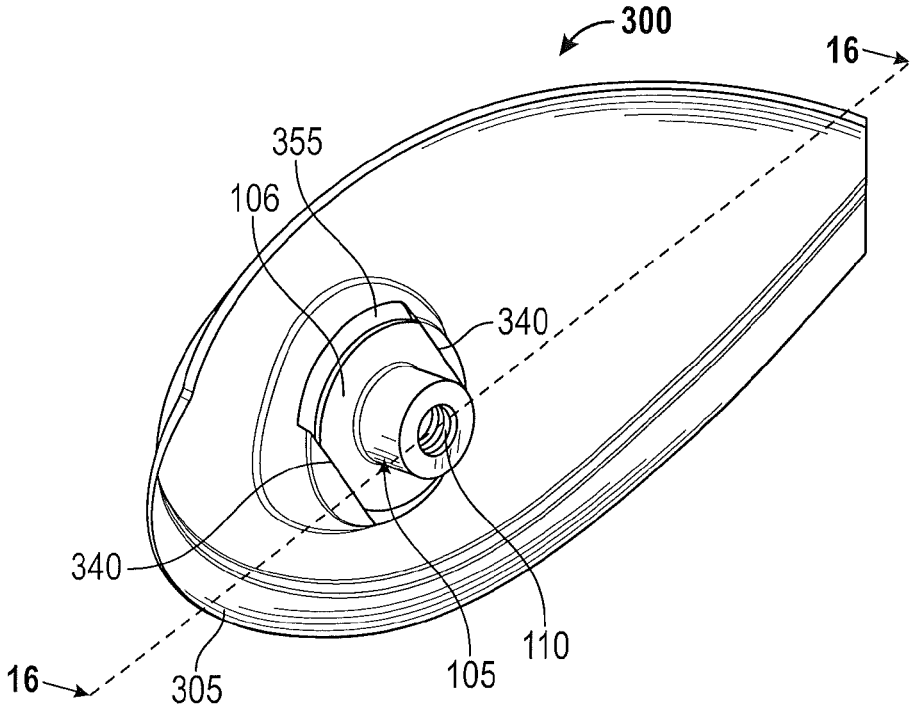
FIG. 15 is a rear perspective view of another embodiment of a composite body patch of the present invention.

In the embodiment shown in FIGS. 15 and 16, the metal screw-receiving boss 105 has a slight "T" shape such that an upper portion 107 extends partly into the weight receiving region 100 of the integrally formed weight port 350. This configuration provides a greater contact surface between the metal screw-receiving boss 105 and the weight port 350, and thus decreases the likelihood that the boss 105, and thus the weight 200, will detach from the weight port 350. The weight 200 will have minimal contact with the boss 105 at the upper portion 107, so a user may wish to insert a washer or o-ring into the weight port 350 to prevent unwanted friction. In this embodiment, the flange 106 rests against and is bonded to the interior surface 352 of the weight receiving region 100 of the weight port 350. As shown in FIG. 15, the interior surface 352 of the weight receiving region 100 has a depression 355 that is sized to receive the flange 106, and also has keyed sides 340 to prevent the metal screw-receiving boss 105 from twisting once it is placed and bonded within the depression 355.

Figure 17:
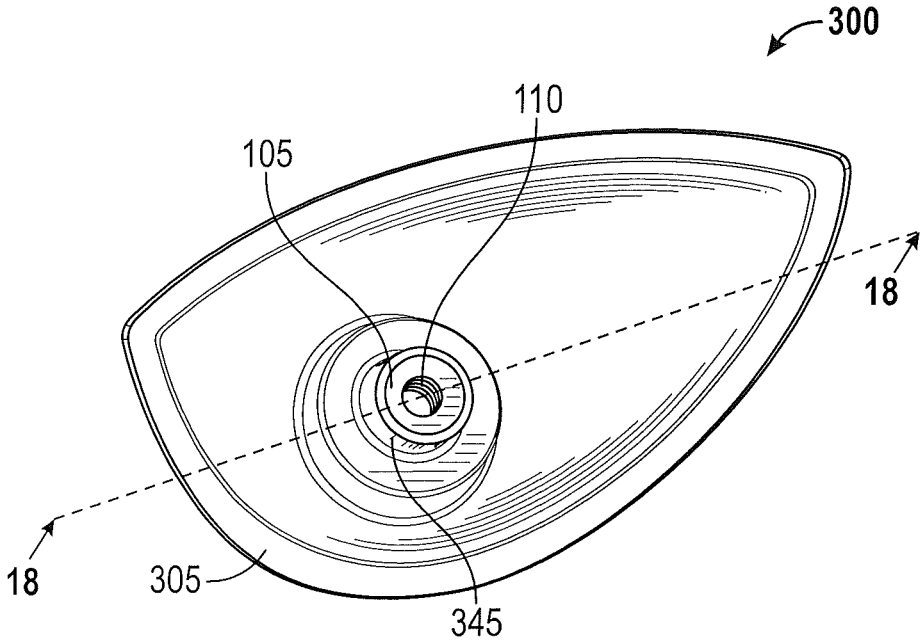
FIG. 17 is a rear perspective view of another embodiment of a composite body patch of the present invention.

The embodiment shown in FIGS. 17 and 18 is similar to the one shown in FIG. 7, as the flange 106 of the metal screw-receiving boss 105 rests against and is bonded to the exterior surface 353 of the weight receiving region 100. In this embodiment, however, the weight receiving region 100 of the weight port 350 has a tube portion 345 extending away from the weight port 350. The metal screw-receiving boss 105 is received within and bonded to the tube portion 345, thus providing significant contact and bonding surface to prevent the boss 105 from disengaging from the weight port 350. In this configuration, the weight 200 directly contacts the boss 105, so a user can place a washer between the boss 105 and the weight 200 to prevent unwanted friction.

Figure 19:
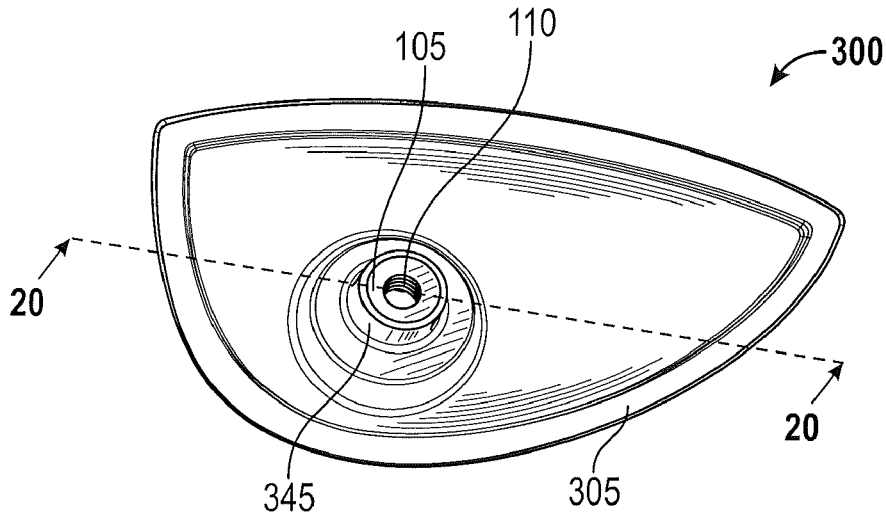
FIG. 19 is a rear perspective view of another embodiment of a composite body patch of the present invention.
Figure 20:
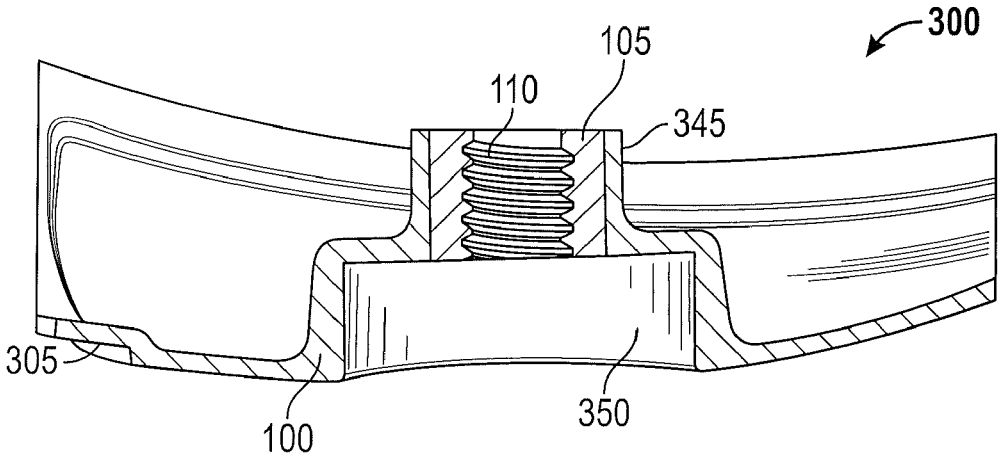
FIG. 20 is a cross-sectional view of the composite body patch shown in FIG. 19 along lines 20-20.

The embodiment shown in FIGS. 19 to 20 is similar to the embodiment shown in FIGS. 18 and 19, as the weight port 350 also includes the tube portion 345. The boss 105 in this embodiment, however, is much smaller than in the other embodiments because it lacks a flange 106, and is retained entirely within the tube portion 345. This configuration reduces the amount of material needed to form the boss 105, and thus reduces the overall weight of the weight port 350. Furthermore, since the weight 200 will have only minimal contact with the boss, a washer or o-ring is not needed to reduce friction.

In other embodiments, the face component 30 and crown 62 may be made from cast or forged metals or from composite materials, and may be formed integrally or pieced together. In yet other embodiments, the face component 30 and crown 62 each may be composed of different materials. The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head of the present invention may be constructed to take various shapes, including traditional, square, rectangular, or triangular. In some embodiments, the golf club head of the present invention takes shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, the disclosure of each of which is incorporated in its entirety herein. The golf club of the present invention may also have the variable face thickness patterns disclosed in U.S. Patent Application Publication No. 20100178997, the disclosure of which is incorporated in its entirety herein.

Another aspect of the golf club head 40 of the present invention is directed a golf club head 40 that has a high coefficient of restitution for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The golf club head 40 preferably has a coefficient of restitution ranging from 0.80 to 0.94, as measured under conventional test conditions.

The coefficient of restitution of the club head 40 of the present invention under standard USGA test conditions with a given ball preferably ranges from approximately 0.80 to 0.94, more preferably ranges from 0.82 to 0.89 and is most preferably 0.86.

As defined in *Golf Club Design, Fitting, Alteration & Repair,* 4$^{th}$ Edition, by Ralph Maltby, the center of gravity, or center of mass, of the golf club head 40 is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 40 are preferably measured using a test frame ($X^T$, $Y^T$, $Z^T$), and then transformed to a head frame ($X^H$, $Y^H$, $Z^H$). The center of gravity of a golf club head 40 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head 40, the scales allow one to determine the weight distribution of the golf club head when the golf club head 40 is placed on both scales simultaneously and weighed along a particular direction, the X, Y or Z direction.

In general, the moment of inertia, Izz, about the Z axis for the golf club head 40 of the present invention is preferably greater than 3000 g-cm$^2$, and more preferably greater than 3500 g-cm$^2$. The moment of inertia, Iyy, about the Y axis for the golf club head 40 of the present invention is preferably in the range from 2000 g-cm$^2$ to 4000 g-cm$^2$, more preferably from 2300 g-cm$^2$ to 3800 g-cm$^2$. The moment of inertia, Ixx, about the X axis for the golf club head 40 of the present invention is preferably in the range from 1500 g-cm$^2$ to 3800 g-cm$^2$, more preferably from 1600 g-cm$^2$ to 3100 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a striking face;

an aft body comprising an interior surface, an exterior surface, and a cutout portion; and a composite body patch comprising an interior surface, an exterior surface, and at least one, integrally formed weight port, wherein the weight port comprises a composite component and a metal boss, wherein the metal boss is affixed to the exterior surface of the composite body patch, and wherein the composite body patch is affixed to the aft body and covers the cutout portion.

2. The golf club head of claim 1, wherein the aft body further comprises a ledge surrounding the cutout portion, and wherein a portion of the interior surface of the composite body patch is affixed to the exterior surface of the ledge with an adhesive.

3. The golf club head of claim 1, wherein the composite body patch further comprises a ledge, and wherein the exterior surface of the ledge is affixed to a portion of the interior surface of the aft body with an adhesive.

4. The golf club head of claim 1, wherein the aft body comprises a crown, a ribbon, and a sole.

5. The golf club head of claim 4, wherein the cutout portion is located in the sole.

6. The golf club head of claim 4, wherein the cutout portion is located in the ribbon.

7. The golf club head of claim 4, wherein the cutout portion is located in both the sole and the ribbon.

8. The golf club head of claim 1, further comprising a composite crown, wherein the aft body comprises a sole and a ribbon, and wherein the aft body is composed of a metal material.

9. The golf club head of claim 1, further comprising a removable weight screw comprising a head portion and a screw portion.

10. The golf club head of claim 1, wherein the golf club head is selected from the group consisting of a fairway wood, a hybrid, and a driver.

11. A golf club head comprising:

a metal striking face;

a crown;

a sole comprising a cutout portion;

a composite body patch;

a threaded boss; and a weight screw, wherein the composite body patch comprises at least one, integrally formed weight port, wherein the threaded boss is affixed to the at least one weight port, wherein the composite body patch is affixed to the sole and covers the cutout portion, and wherein the cutout portion is located on a toe section of the sole.

12. The golf club head of claim 11, wherein the crown is composed of a composite material and the sole is composed of a metal alloy.

13. The golf club head of claim 11, wherein the composite body patch has an asymmetrical shape.

14. A wood-type golf club head comprising:

a metal face component comprising a striking surface and a return portion;

a metal aft body comprising a toe side, a heel side, a crown, a sole, a ribbon, and a cutout portion;

a composite body patch comprising an exterior surface, an interior surface, a ledge, and at least one, integrally formed weight port;

a threaded boss; and a weight screw comprising threads sized to fit within the threaded boss, wherein the threaded boss is affixed to the weight port, wherein an exterior surface of the ledge is affixed to the interior surface of the aft body with an adhesive material such that the composite patch fully covers the cutout portion, and wherein the golf club head has a volume of 200 cubic centimeters to 500 cubic centimeters.

15. The wood-type golf club head of claim 14, wherein the cutout portion is located in the sole proximate a toe side of the golf club head.

16. The wood-type golf club head of claim 14, wherein the cutout portion is located in both the sole and the ribbon.

17. The wood-type golf club head of claim 14, wherein the threaded boss is composed of a lightweight metal alloy.

* * * * *